US011644767B2

(12) United States Patent
Suzuki

(10) Patent No.: US 11,644,767 B2
(45) Date of Patent: May 9, 2023

(54) IMAGE FORMING APPARATUS

(71) Applicant: CANON KABUSHIKI KAISHA, Tokyo (JP)

(72) Inventor: Takahiro Suzuki, Saitama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/479,012

(22) Filed: Sep. 20, 2021

(65) Prior Publication Data

US 2022/0113652 A1 Apr. 14, 2022

(30) Foreign Application Priority Data

Oct. 12, 2020 (JP) ..... JP2020-172010
Sep. 2, 2021 (JP) ..... JP2021-143046

(51) Int. Cl.
*G03G 15/06* (2006.01)
*G03G 15/10* (2006.01)

(52) U.S. Cl.
CPC ..... *G03G 15/065* (2013.01); *G03G 15/104* (2013.01)

(58) Field of Classification Search
CPC ..... G03G 15/064; G03G 15/104
See application file for complete search history.

(56) References Cited

U.S. PATENT DOCUMENTS 5,923,356 A * 7/1999 Gibson ..... G03G 15/105 399/58
10,719,036 B2 7/2020 Tanaka

FOREIGN PATENT DOCUMENTS

| | | | |
|---|---|---|---|
| JP | H11-65295 | A | 3/1999 |
| JP | 2000-019852 | A | 1/2000 |
| JP | 2000-066515 | A | 3/2000 |
| JP | 2011-070122 | A | 4/2011 |
| JP | 2018-059956 | A | 4/2018 |

* cited by examiner

*Primary Examiner* — Roy Y Yi
*Assistant Examiner* — Andrew V Do
(74) *Attorney, Agent, or Firm* — Venable LLP

(57) ABSTRACT

An image forming apparatus includes a first container to accommodate liquid developer for replenishment to a developing container, and a second container to accommodate carrier fluid containing a charge control agent for replenishment to the first container. The concentration of the charge control agent in the carrier fluid accommodated in the second container is between equal to or more than 10 wt % and equal to or less than 20 wt %. A driving unit is driven so as to replenish the charge control agent accommodated in the second container to the first container, and a control unit controls the driving unit based on image coverage of an output image so that a concentration of the charge control agent in the liquid developer accommodated in the first container becomes a predetermined value.

6 Claims, 17 Drawing Sheets

IMAGE FORMING APPARATUS

BACKGROUND OF THE INVENTION

Field of the Invention

This invention relates to a developing apparatus using a wet type developing system in which an electrostatic latent image borne on a latent image bearing member is developed by a liquid developer dispersing a toner in a medium liquid, and an image forming apparatus forming an image by use of the developing apparatus of the wet type developing system.

Description of the Related Art

An electrophotographic system which forms an image by developing an electrostatic latent image formed on an image bearing member such as a photosensitive member with a charged particle (toner) is roughly divided into two types. They are a dry type developing system that uses a powder toner directly, and a wet type developing system that uses a liquid developer dispersing the toner in a liquid. Among these, since the toner is dispersed in a medium (carrier) fluid, the wet type developing system is capable of forming an image by controlling the particle having a particle diameter of a submicron order, and is a promising developing system in view of high image quality and high image definition.

In the wet type developing system, the image is formed by migrating the toner particle contained in the liquid developer onto the media by electrophoresis. In particular, at first, at a portion facing a film formation electrode, a film of the developer containing an appropriate amount of the toner is formed, and a layer of the developer having an appropriate film thickness is formed on a developing roller by a squeezing roller. Thereafter, in a developing process, development is performed by causing the electrophoresis of the toner onto the photosensitive drum by an electric field in accordance with the electrostatic laten image formed on the photosensitive drum at a developing nip portion where a developing roller and the photosensitive drum come into contact with each other. As a principle of image formation, basically all the toners are moved by the electric field in each process of a primary transfer and a secondary transfer after the developing process.

So as to secure a required electric charge amount of a toner for migrating the toner in a developing unit, it is necessary to maintain a concentration of a charge control agent in the liquid developer at an appropriate level. However, since most of the charge control agent is considered to be charged in the polarity opposite of the polarity of the toner, when an image forming operation is performed in succession, in a case of an image having a large non-image area, the charge control agent moves to a side of the photosensitive drum and collected by a photosensitive drum cleaning member. As a result, the concentration of the charge control agent is reduced and the electric charge amount of the toner becomes insufficient, so that it becomes not possible to migrate a sufficient quantity of the toner to the photosensitive drum for the development at the developing portion and a problem of a decrease in the density of an output image occurs. Further, in the non-image area, the toner is not adequately pressed onto the developing roller, a problem of fogging occurs.

So as to deal with these problems, Japanese Patent Laid-Open No. H11-65295 performs the adjustment of the concentration of the charge control agent in the developer by replenishing the charge control agent from a charge control agent container based on an optical reflection density of the toner image formed on the photosensitive drum or a recording paper. Further, in Japanese Patent Laid-Open No. 2000-19852, by measuring the electric potential of a toner adhesion surface of a roller electrode inside a detecting apparatus, the concentration of the charge control agent is determined based on a measured value.

The suggested methods mentioned above predict the concentration of the charge control agent by periodically forming the toner image for the detection of the concentration of the charge control agent, and, by replenishing the charge control agent from the charge control agent container so as to adjust the concentration of the charge control agent, supplement the degradation of the image quality due to the reduction in the concentration of the charge control agent. However, since the concentration of the charge control agent changes at each image formation, it is not possible to respond to the reduction in the concentration of the charge control agent between periodical controls of the concentration. Further, since the formation of the toner image for the detection and the measurement takes time, in some cases a frequent control of the concentration of the charge control agent causes the decrease in productivity.

SUMMARY OF THE INVENTION

The present invention provides an image forming apparatus configured to stabilize image density by predicting a concentration of a charge control agent taking image coverage into consideration and replenishing the charge control agent.

According to one aspect of the present invention, an image forming apparatus includes an image bearing member on which an electrostatic image is formed, an exposing unit configured to expose the image bearing member so as to form the electrostatic image on the image bearing member, a developing apparatus including a developing container and a developer bearing member, the developing container being configured to accommodate a liquid developer containing a toner and a carrier fluid, the developer bearing member being configured to bear and convey the liquid developer so as to develop the electrostatic image formed on the image bearing member, a first container configured to accommodate the liquid developer for replenishment to the developing container, a second container configured to accommodate a charge control agent for replenishment to the first container, a driving unit configured to be driven so as to replenish the charge control agent accommodated in the second container to the first container, and a control unit configured to control the driving unit based on image coverage of an output image so that a concentration of the charge control agent in the liquid developer accommodated in the first container becomes a predetermined value.

According to another aspect of the present invention, an image forming apparatus includes an image bearing member on which an electrostatic image is formed, an exposing unit configured to expose the image bearing member so as to form the electrostatic image on the image bearing member, a developing apparatus including a developing container and a developer bearing member, the developing container being configured to accommodate a liquid developer containing a toner and a carrier fluid, the developer bearing member being configured to bear and convey the liquid developer so as to develop the electrostatic image formed on the image bearing member, a first container configured to accommodate the liquid developer for replenishment to the developing container, a second container configured to accommodate a charge control agent for replenishment to the first container, a driving unit configured to be driven so as to replenish the charge control agent accommodated in the second container to the first container, and a control unit configured to control the driving unit so that a replenishment amount of the charge control agent replenished from the second container to the first container in a case where image coverage of an output image is a second ratio is more than the replenishment amount in a case where the image coverage of the output image is a first ratio that is larger than the second ratio.

Further features of the present invention will become apparent from the following description of exemplary embodiments with reference to the attached drawings.

DESCRIPTION OF THE EMBODIMENTS

Hereinafter, examples of an image forming apparatus of this disclosure will be described.

Example 1

Image Forming Apparatus

At first, a configuration of an image forming apparatus 100 of this example will be described based on FIG. 1.

An intermediate transfer belt 70 is rotatably driven while coming into contact with photosensitive drums 20Y, 20M, 20C, and 20K and a secondary transfer unit 80. Toners of four colors are superimposed on the intermediate transfer belt 70 in sequence by primary transfer units 60Y, 60M, 60C, and 60K constructed by the intermediate transfer belt 70, primary transfer backup rollers 61Y, 61M, 61C, and 61K, and the photosensitive drums 20Y, 20M, 20C, and 20K.

The secondary transfer unit 80 transfers a toner image formed on the intermediate transfer belt 70 to a recording medium such as a paper. The toner image transferred to the recording medium is fixed on the recording medium by a fixing unit, not shown.

Developing units 50Y, 50M, 50C, and 50K are capable of developing latent images by liquid developers containing toner particles which respectively develop colors of yellow (Y), magenta (M), cyan (C), and black (K).

To be noted, since the developing units 50Y, 50M, 50C, and 50K of each color, including peripheral configurations thereof, are similar to each other, hereinafter, the developing unit 50K and the periphery thereof will be described in detail, and descriptions of the other developing units 50Y, 50M, and 50C will be omitted herein.

Figure 1:
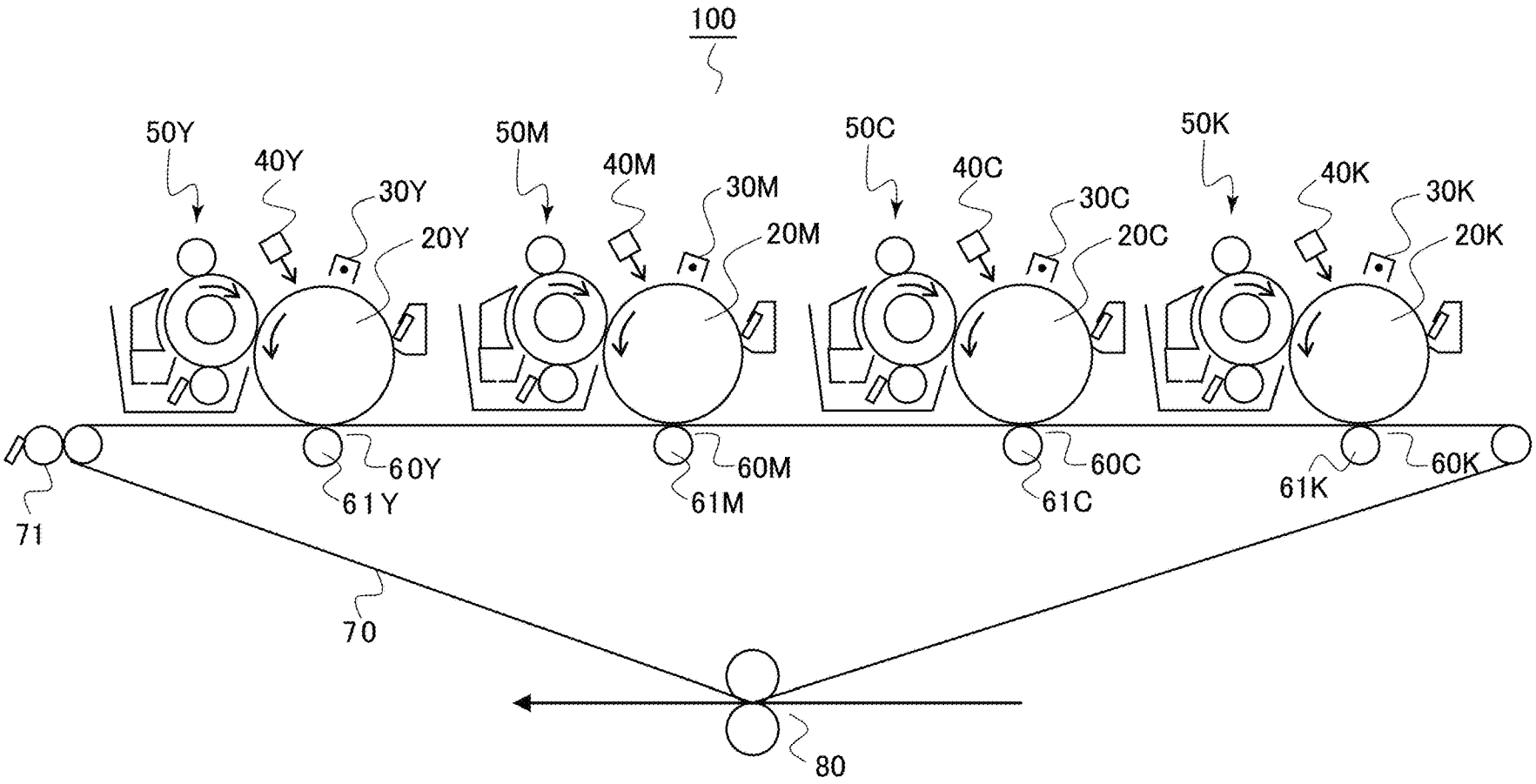
FIG. 1 is a diagram showing a configuration of an image forming apparatus of embodiments of this disclosure.

As shown in FIG. 1, a charge unit 30K charging the photosensitive drum, an exposing unit 40K forming an electrostatic latent image (an electrostatic image) on the photosensitive drum 20K that has been charged, and the primary transfer unit 60K are disposed around the photosensitive drum 20K along a rotational direction of the photosensitive drum 20K. The photosensitive drum 20K which includes a cylindrical substrate and a photosensitive layer formed on a circumferential surface of the substrate is rotatable around a central axis as the center, and in this example rotates in a counter-clockwise direction as shown by an arrow in FIG. 2.

The charge unit 30K is an apparatus to charge the photosensitive drum 20K. The exposing unit 40K includes a semiconductor laser, a polygon mirror, an F-θ lens, and the like, and forms the latent image by irradiating the photosensitive drum 20K, that has been charged, with a modulated laser beam.

The developing unit 50K is an apparatus to develop the latent image formed on the photosensitive drum 20K with the liquid developer of black (K). The detail of the developing unit 50K will be described later.

The primary transfer unit 60K is an apparatus to transfer the toner image formed on the photosensitive drum 20K to the intermediate transfer belt 70.

Developing Apparatus

Next, a configuration of a developing apparatus of this example will be described based on FIG. 2.

In the developing unit 50K, around a developing roller 51, serving as a developer bearing member that bears and conveys the liquid developer to the photosensitive drum 20K, as the center, a developer feed container 55, a film formation electrode 52, and a squeezing roller 53 are disposed upstream of the photosensitive drum 20K, and a developing cleaning roller 54 is disposed downstream of the photosensitive drum 20K. At this point, the film formation electrode 52, the squeezing roller 53, and the developing cleaning roller 54 respectively assume a role of bringing the toner contained in the liquid developer supplied from the developer feed container 55 to the developing roller 51 by the electric field, a role of preparing a developer layer of several μm (micrometer) on the developing roller 51 by squeezing a superfluous carrier fluid while packing the toner particle by the electric field at the same time, and a role of collecting a residual toner remaining in a non-image area from the developing roller 51 by the electric field.

The developer feed container 55 is a container temporarily accommodating the liquid developer for the development of the latent image formed on the photosensitive drum 20K so as to feed the liquid developer to the developing roller 51. The liquid developer whose mass concentrations of the toner particle and the charge control agent have been respectively adjusted at about 3 wt % (weight %) and about 0.1 wt % is fed to the developer feed container 55 from a developer agitation container 57. While an average particle size of the toner in the liquid developer is generally 0.5 to 2.0 μm, the liquid developer used in this example is a liquid developer in which the toner particle dispersing a coloring matter such as pigment in polyester resin and having the average particle size of 0.8 μm is added to a carrier fluid such as organic solvent with a toner dispersant and the charge control agent, and a surface of the toner particle is charged to negative polarity. A moving amount and a pressing degree of the toner particle are controlled by adjusting a difference in the electric potential disposed between each member. To be noted, densities of the toner particle and the carrier fluid are respectively set at 1.3 g/cm$^3$ and 0.9 g/cm$^3$. Further, Lipidure-S (trade name, manufactured by NOF CORPORATION) is used as the charge control agent.

A developer container 581 is a container accommodating the developer containing the toner, and assumes a role of feeding the developer to the developer agitation container 57. While a mass concentration of the toner in the developer inside the developer container 581 is generally between equal to or more than 15 wt % and equal to or less than 25 wt %, in this example, the mass concentration is about 20 wt %. The developer container 581 is disposed one for each color of Y, M, C, and K of the developing units 50Y, 50M, 50C, and 50K, and each color of the developer agitation container 57 is fed from each color of the developer container 581. To be noted, in this example, a mass concentration of the charge control agent in the developer accommodated in the developer container 581 is zero (0 wt %).

A carrier container 582 is a container to accommodate the carrier fluid, and assumes a role of replenishing the carrier fluid to the developer agitation container 57. To be noted, in this example, the mass concentration of the charge control agent in the carrier fluid accommodated in the carrier container 582 is zero (0 wt %).

A charge control agent container 583 is a container to accommodate the carrier fluid containing equal to or more than a certain specified quantity of the charge control agent. The charge control agent container 583 assumes a role of replenishing the charge control agent to the developer agitation container 57 in a case where a control unit of the image forming apparatus 100 predicts the reduction in the concentration of the charge control agent in the liquid developer inside the developer agitation container 57. While a concentration of the charge control agent in the carrier fluid accommodated in the charge control agent container 583 is generally between equal to or more than 10 wt % and equal to or less than 20 wt %, in this example, the concentration is set at 15 wt %. An agitating member so as to agitate the developer (toner) replenished from the developer container 581 serving as a fourth container, the carrier fluid replenished from the carrier container 582 serving as a third container, and the carrier fluid (charge control agent) replenished from the charge control agent container 583 is disposed in the developer agitation container 57.

To be noted, there is one single container of the carrier container 582, and the carrier fluid is replenished to each color of the developing units 50Y, 50M, 50C, and 50K from the same carrier container 582. Further, there is one single container of the charge control agent container 583, and the carrier fluid containing equal to or more than the certain specified quantity of the charge control agent (concentration of the charge control agent in the carrier fluid is between equal to or more than 10 wt % and equal to or less than 20 wt %) is replenished to each color of the developing units 50Y, 50M, 50C, and 50K from the same charge control agent container 583.

While, in general, a process speed of image formation is 500 mm/s (millimeter/second) to 2,000 mm/s, in this example, the process speed of the image formation is set at 800 mm/s, and roller shaped members mentioned above contributing to the image formation are rotatably driven so that surface peripheral speeds become 800 mm/s.

The length of a surface of the film formation electrode 52 facing the developing roller 51 is 24 mm, and a gap of 400±30 μm is formed with the developing roller 51 in between. The liquid developer fed from the developer agitation container 57 to the developer feed container 55 is drawn into the gap between the developing roller 51 and the film formation electrode 52 by the rotation of the developing roller 51. While passing through the gap formed between the developing roller 51 and the film formation electrode 52, the toner in the liquid developer is pulled to a side of the developing roller 51 by an electric field generated by a difference in the electric potential between the developing roller 51 and the film formation electrode 52.

The squeezing roller 53 is a roller made of metal, and, in this example, a roller made of stainless steel with a diameter of 16 mm is used. The squeezing roller 53 comes into pressure contact with the developing roller 51 so that pressure between the squeezing roller 53 and the developing roller 51 becomes constant over a whole length in a longitudinal direction (in this example, 354 mm), and, as shown in FIG. 2, rotates in a counter-clockwise direction. The liquid developer passed through the film formation electrode 52 passes through a nip portion formed by the developing roller 51 and the squeezing roller 53 and having a gap thickness of 6 μm and a width of about 3 mm. In the nip portion, the toner is pushed to the side of the developing roller 51 by an electric field generated by a difference in the electric potential between the developing roller 51 and the squeezing roller 53, and a layer of the toner and a layer of the carrier are formed. At an outlet of the nip portion, the layer of the carrier is split between the developing roller 51 and the squeezing roller 53. As a result, in this example, a mass concentration of the toner in the liquid developer forming a film on the developing roller 51 becomes 50±5 wt %.

On the other hand, the liquid developer which, after having passed through the gap between the developing roller 51 and the film formation electrode 52, is not able to flow into the nip portion between the developing roller 51 and the squeezing roller 53 flows to a developer collecting container 56 along a rear surface of the film formation electrode 52 in a manner being bounced off by the squeezing roller 53.

Figure 2:
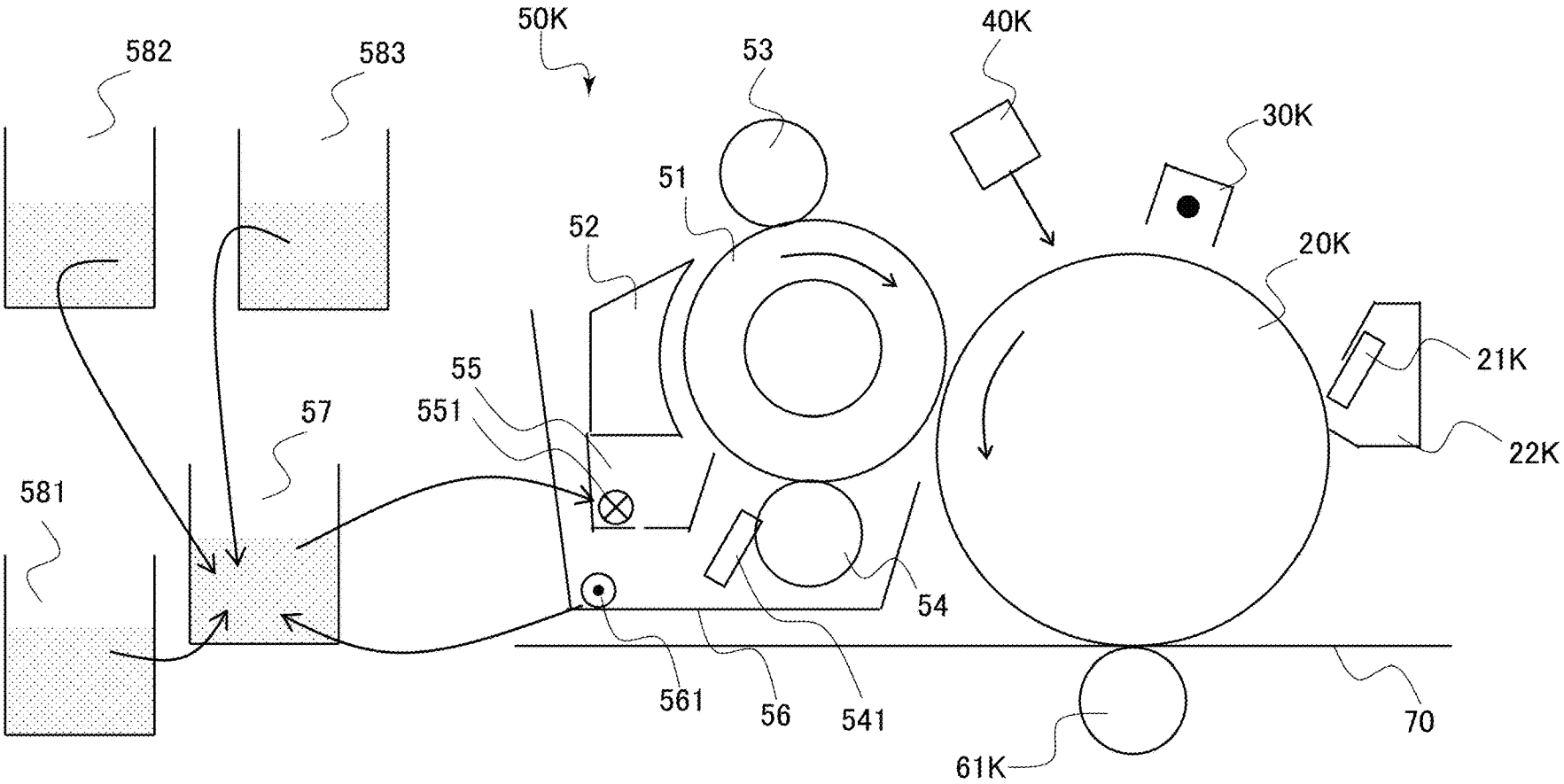
FIG. 2 is a configuration of a developing apparatus of an example 1 of this disclosure.

As shown in FIG. 2, the developing cleaning roller 54 comes into contact with a developing cleaning blade 541. The developing cleaning blade 541 is a blade made of stainless steel with a thickness of 0.2 mm and a free length of 20 mm, and an edge of the developing cleaning blade 541 abuts on the developing cleaning roller 54 with an inclined angle of 30±3 degrees from a vertical direction in a counter direction with respect to a rotational direction of the developing cleaning roller 54. The toner particle collected from the developing roller 51 to a surface of the developing cleaning roller 54 is scraped by the developing cleaning blade 541, and flows to the developer collecting container 56 along an incline of the developing cleaning blade 541.

The liquid developer flown to the developer collecting container 56 is discharged from a developer discharge port 561, and returns to the developer agitation container 57. As shown in FIG. 2, the liquid developer circulates between the developing unit 50K and the developer agitation container 57. Therefore, the charge control agent in the liquid developer inside the developing unit 50K and the charge control agent in the liquid developer inside the developer agitation container 57 are maintained substantially at the same concentration. Further, the toner in the liquid developer inside the developing unit 50K and the toner in the liquid developer inside the developer agitation container 57 are maintained substantially at the same concentration.

As described in detail below, the toner particle in the layer of the liquid developer on the developing roller 51 forms a visible image at a facing portion of the developing roller 51 and the photosensitive drum 20K, namely a developing portion, after the latent image drawn on the photosensitive drum 20K.

The photosensitive drum 20K is a cylindrical member which is larger than the developing roller 51 in width and formed with a photosensitive layer on an outer peripheral surface, and, as shown in FIG. 2, is rotatably driven in the counter-clockwise direction. Usually, the photosensitive layer of the photosensitive drum 20K is constructed by organic photoreceptor, amorphous silicon photoreceptor, or the like. In this example, the photosensitive layer of the photosensitive drum is formed by a mixture of amorphous silicon and amorphous carbon, and a diameter of the photosensitive drum is 84 mm.

Adjacent to the photosensitive drum 20K, the charge unit 30K charging the photosensitive drum 20K and the exposing unit 40K forming the electrostatic latent image on the photosensitive drum 20K that has been charged are disposed upstream of the developing portion.

The charge unit 30K is an apparatus which charges the photosensitive drum 20K. In this example, the charge unit 30K is constructed by a corona electrostatic charger, and, by applying a voltage of about −4.5 kV (kilovolt) to −5.5 kV to a charging wire, a surface of the photosensitive drum is charged to −500 V (volt). The exposing unit 40K includes the semiconductor laser, the polygon mirror, the F-θ lens, and the like, and forms the electrostatic latent image by irradiating the surface of the photosensitive drum 20K, that has been charged, with the modulated laser beam. In this example, the exposing unit 40K forms the latent image so that the electric potential of an image portion becomes about −100 V.

In this example, a bias voltage of about −300 V is applied to the developing roller 51, and, in accordance with an electric field formed by the electrostatic latent image on the photosensitive drum 20K (image portion: −100 V, non-image portion: −500 V), in the image portion, the toner particle migrates onto the photosensitive drum 20K by the electrophoresis, and, in the non-image portion, remains on the developing roller 51 since the electric field acts in a direction of pushing the toner particle onto the developing roller 51. Herewith, the visual image is formed on the photosensitive drum 20K by the toner particle. So as to migrate an adequate quantity of the toner to the image portion at the developing portion, it is desired that the charge control agent in the liquid developer inside the developing unit 50K and the developer agitation container 57 is always maintained at an appropriate concentration.

Means of Predicting Concentration of Charge Control Agent

Next, a means of predicting the concentration of the charge control agent will be described in detail.

As considered from a function of the charge control agent added so as to apply an electric charge amount to the toner, the charge control agent added so as to control the electric charge amount of the toner is considered to be charged in the polarity opposite the polarity of the toner in the liquid developer. Therefore, it is considered that the charge control agent moves in an opposite direction of the toner at the developing nip portion where the electric field is applied to the toner, and, as a result, at a splitting portion at the outlet of the nip portion, a large quantity of the charge control agent exists on a roller opposite of a roller on which the toner exists.

Figure 10:
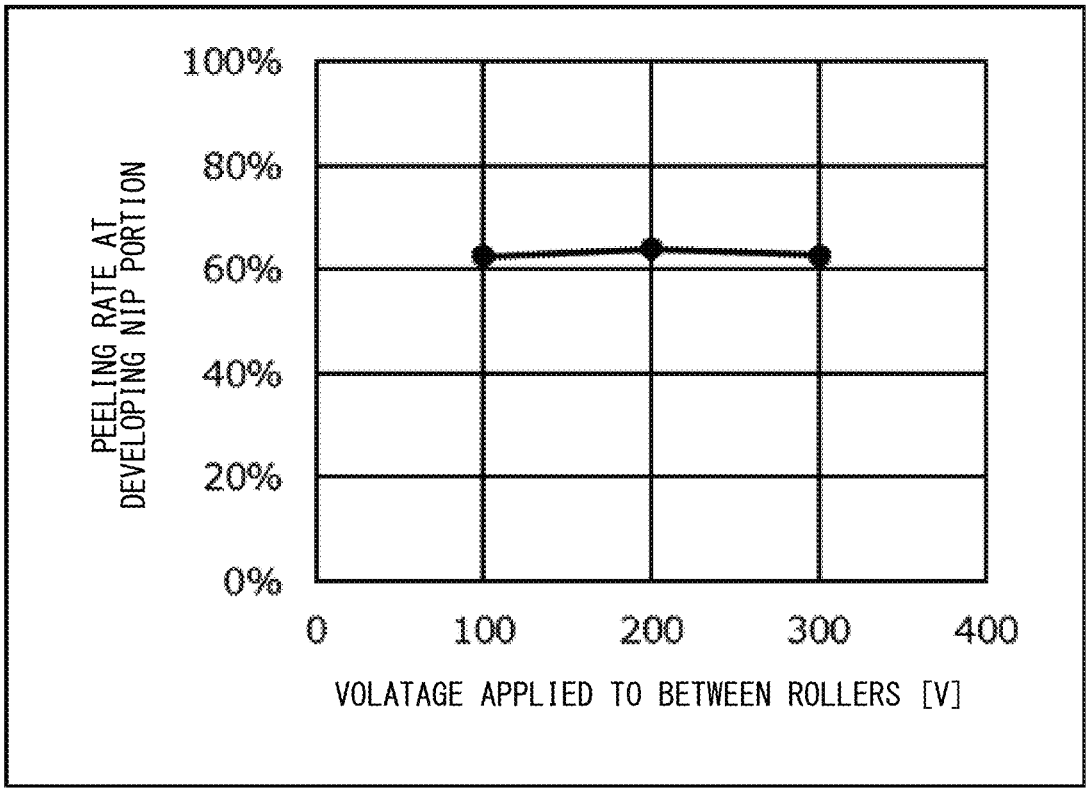
FIG. 10 is a diagram showing a peeling rate of a charge control agent when an electric field is applied to a nip portion.

FIG. 10 shows a result of an experiment by which the state described above has been actually confirmed. The horizontal axis indicates a voltage applied at the developing nip portion, and the vertical axis indicates a rate of the charge control agent moved to a roller opposite a roller to which the toner moves, namely a peeling rate of the charge control agent. Hereinafter, an experimental method will be described in detail.

The experimental apparatus is configured in such a manner that a rubber roller having a rubber layer on a surface layer comes into contact with a metal roller, and that the rubber and metal rollers are rotated without a difference in a peripheral speed in between. Other configurations are the same as described above. Under this condition, a voltage pushing the toner to a side of the rubber roller is applied to a portion between both the rollers, and the liquid developer whose concentration of the charge control agent has been known beforehand is dropped on the rubber roller. The liquid developer that has been dropped penetrates into a nip portion between the rubber and metal rollers by the rotation of the rollers and receives an action of the electric field. Since the toner is pushed to the side of the rubber roller inside the nip portion, only the carrier fluid that has been split remains on a side of the metal roller. Since the charge control agent that has been peeled off by the action of the electric field exists in this carrier fluid that has remained, by bringing the metal roller into contact with the rubber roller so as to collect the carrier fluid and by measuring the concentration of the charge control agent, it is possible to calculate the peeling rate of the charge control agent at a time when the electric field has acted.

As indicated in FIG. 10 showing the experimental result described above, it is found that, when a voltage is applied to the nip portion, about 60% of the charge control agent that has flown in moves to the opposite side of the toner. Since, in a case where the non-image portion has been output in succession, about 60% of the charge control agent which has penetrated into the developing nip portion is collected inside a photosensitive member cleaning liquid collecting portion 22, the more the output is output, the lower the concentrations of the charge control agent inside the developing unit 50K and the developer agitation container 57 become.

Figure 11:
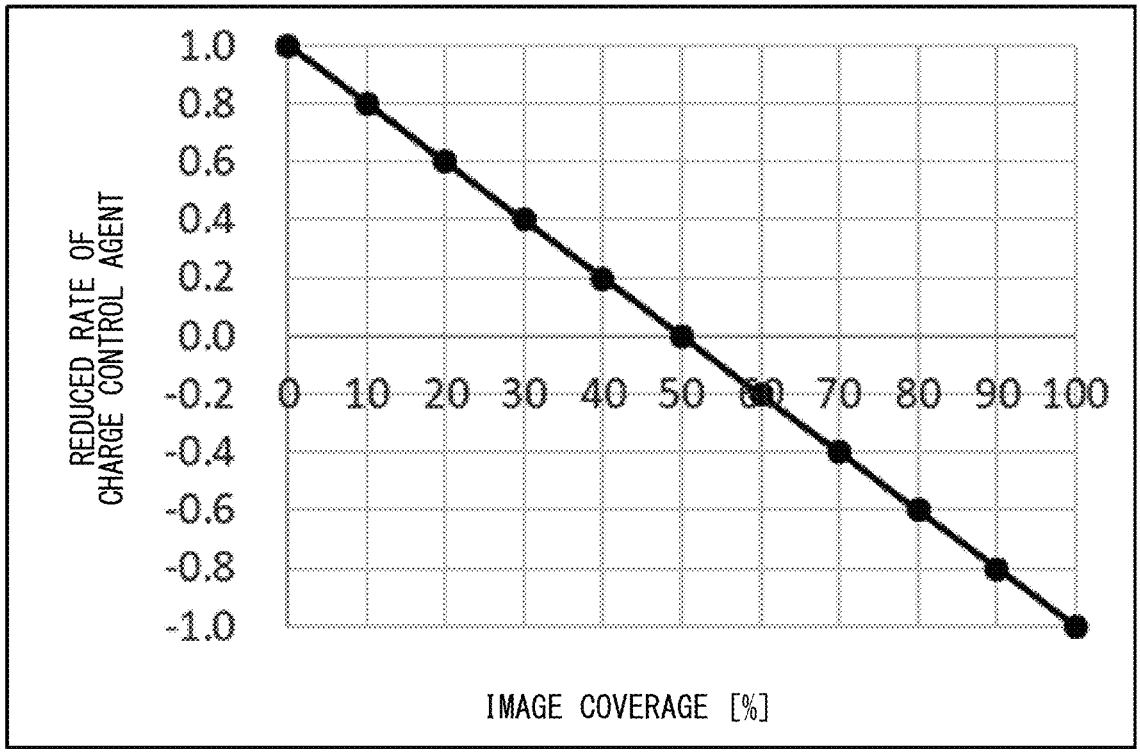
FIG. 11 is a diagram showing the dependency of a reduced rate of the charge control agent on image coverage.

The concentration of the charge control agent is determined by an amount of the charge control agent moving with the toner in the image area and an amount of the charge control agent moving as peeled off from the toner in the non-image area. FIG. 11 is a graph calculated with conditions that the concentration of the charge control agent is 0.1 wt % and the peeling rate of the charge control agent at the developing portion is 70%, and shows a reducing rate of the charge control agent inside the developer agitation container 57 with respect to the image coverage. A relative reduced rate is indicated in a manner that the relative reduced rate of the charge control agent is one in a case where the image coverage is zero. As shown in FIG. 11, it is possible to predict the concentration of the charge control agent from the image coverage of an output image.

Means of Controlling Concentration of Charge Control Agent

Next, a means of controlling the concentration of the charge control agent executed when the decrease in the concentration of the charge control agent is predicted by the means of predicting the concentration of the charge control agent will be described in detail.

Figure 3:
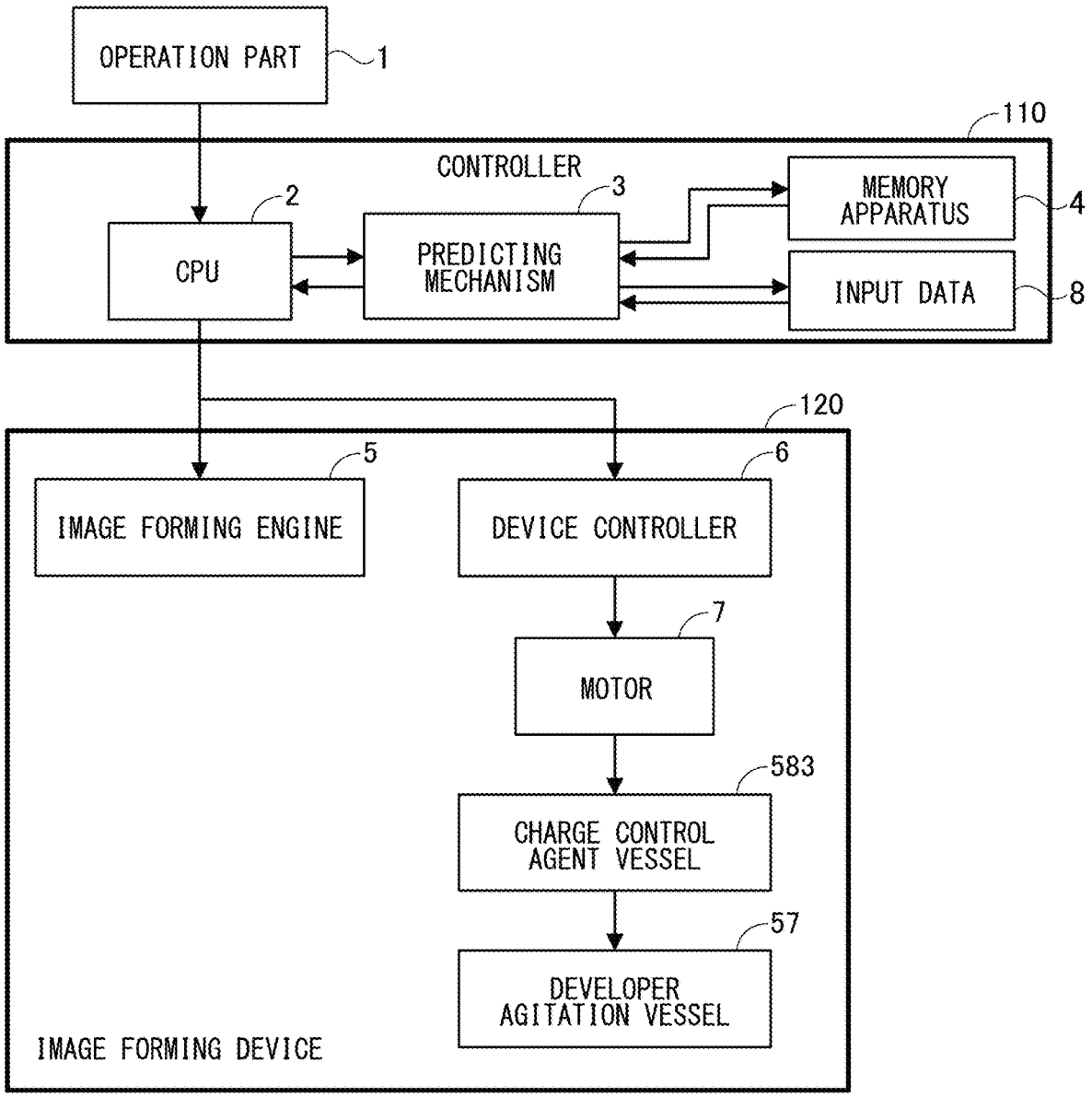
FIG. 3 is a block diagram showing a control system relating to example 1 of this disclosure.

FIG. 3 indicates extracted parts of the control system necessary for embodying the example 1 of this disclosure. A controller 110 in FIG. 3 is a control unit controlling an image forming devise 120 forming the toner image described above, and serves as the means of predicting the concentration of the charge control agent. In particular, the controller 110 includes a CPU (central processing unit) 2, a predicting mechanism 3, a memory apparatus 4, and an input data 8.

The CPU 2 mentioned above is constructed so as to command the image formation to an image forming engine 5, and also acts as a counter to accommodate a cumulative total of sheets of the image formation. Further, the memory apparatus 4 beforehand accommodates the response data recording a response of a consumed amount of the charge control agent to the image coverage. The predicting mechanism 3 determines a predicted value of the concentration of the charge control agent based on the image coverage of the output image. Further, the CPU 2 replenishes the charge control agent from the charge control agent container 583 to the developer agitation container 57 by activating a motor 7 via a devise controller 6 based on the predicted value of the concentration of the charge control agent predicted by the predicting mechanism 3.

That is, in the present invention, the developer agitation container 57 serves as a first container configured to accommodate the liquid developer for replenishment to the developing container, the charge control agent container 583 serves as a second container configured to accommodate a charge control agent for replenishment to the first container, and the motor 7 serves as a driving unit configured to be driven so as to replenish the charge control agent accommodated in the second container to the first container. Then the controller 110 is configured to control the driving unit based on image coverage of an output image so that a concentration of the charge control agent in the liquid developer accommodated in the first container becomes a predetermined value.

Figure 6:
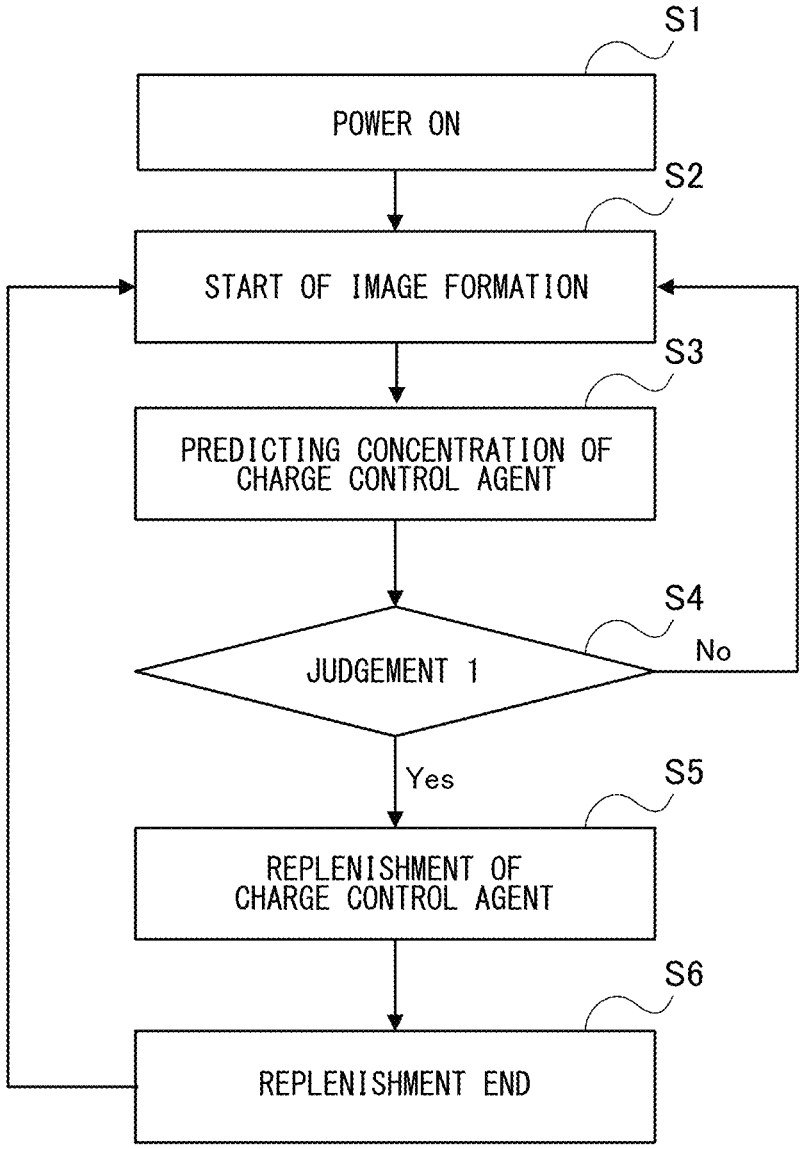
FIG. 6 is a diagram showing a control flowchart of the embodiments of this disclosure.

In particular, in a case where the image formation onto the sheet is started (STEP S2) by turning ON the power of the image forming apparatus 100 (STEP S1 in FIG. 6), at first, a start of the image formation is transmitted to the predicting mechanism 3 of this disclosure from an operation part 1 via the CPU 2. Further, the CPU 2 instructs the image forming engine 5 to perform the image formation.

When the start of the image formation is transmitted, the predicting mechanism 3 predicts a reduced amount of the charge control agent by obtaining the image coverage of the output image from the input data 8 and referring to the response data from the memory apparatus 4 (STEP S3).

In more particular, the predicting mechanism 3 described above at first obtains the image coverage $\alpha$ (%). Then, from a variation ratio $\beta$ which has been accommodated beforehand and is a variation ratio of the concentration of the charge control agent in response to one percent change of the image coverage, the predicting mechanism 3 predicts a reduced rate $X=\beta\times(50-\alpha)$ of the concentration of the charge control agent. Further, the predicting mechanism 3 calculates an updated predicted value $Y=Y0\times(1-X/100)$ of the concentration of the charge control agent from a predicted value Y0 of the concentration of the charge control agent before the start of the image formation and the reduced rate X of the concentration of the charge control agent. Then, the predicted value Y0 of the concentration of the charge control agent is updated with the updated predicted value Y.

The CPU 2 judges whether or not the updated predicted value Y of the concentration of the charge control agent described above falls below a specified value Z (for example, 0.08 wt % at which concentration of the charge control agent it is possible to achieve adequate image density) (STEP S4, JUDGEMENT 1). Then, every time when the updated predicted value Y of the concentration of the charge control agent falls below the specified value Z, namely in a case where Y is equal to or lower than Z (STEP S4: YES), by starting the motor 7 mentioned above (time t1 in FIG. 8) and replenishing the charge control agent from the charge control agent container 583 so as to increase the concentration of the charge control agent inside the developer agitation container 57, it is possible to bring back the concentration of the charge control agent that has been reduced (STEP S5).

Figure 8:
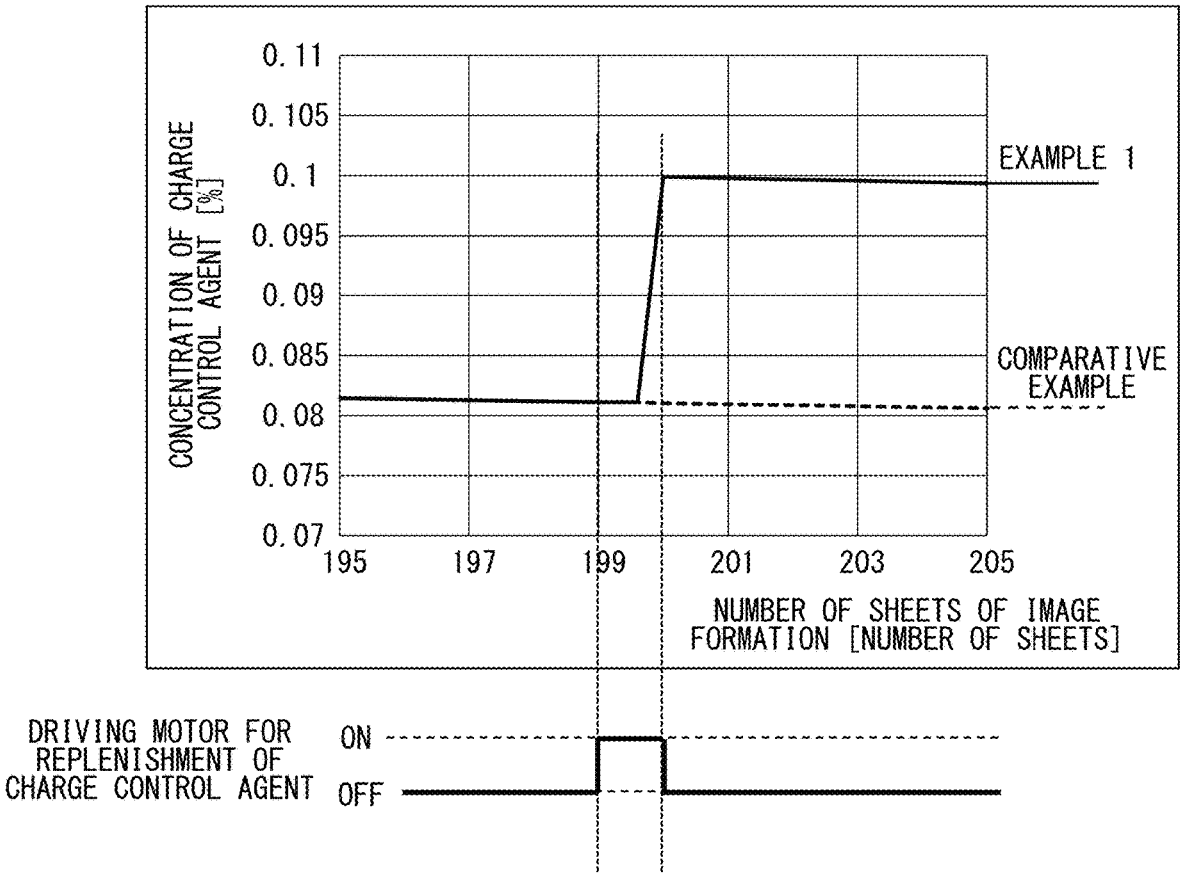
FIG. 8 is a schematic diagram showing a control time chart of the embodiments of this disclosure.

At this time, the replenishment of the charge control agent ends when the replenishment has been performed to increase the concentration of the charge control agent in the liquid developer to a predetermined level for a recovery judgement (for example, a pre-use concentration of the charge control agent) (STEP S6, time t2 in FIG. 8). Then, when the replenishment of the charge control agent has ended, the image formation of the next image is started. To be noted, in a case where the updated predicted value Y of the concentration of the charge control agent does not fall below the specified value Z (STEP S4: NO), the CPU 2 starts the image formation of the next image without replenishing the charge control agent.

Figure 12A:
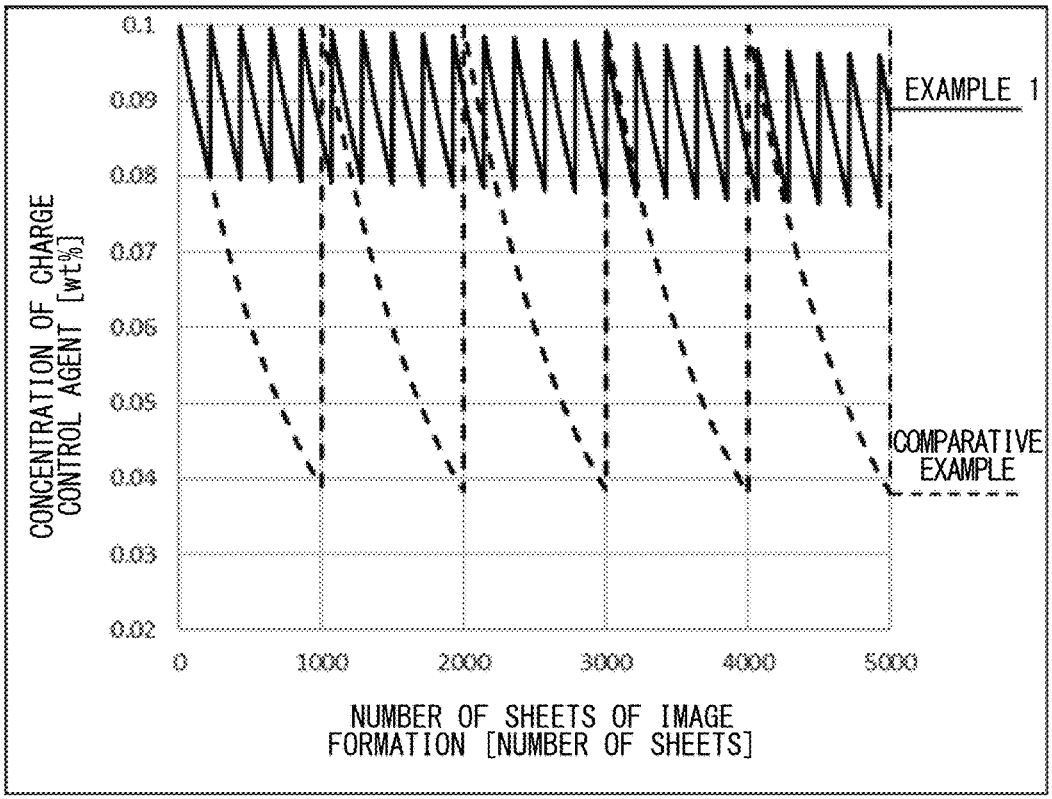
FIG. 12A is a diagram showing a change in a concentration of the charge control agent in example 1 of this disclosure.
Figure 12B:
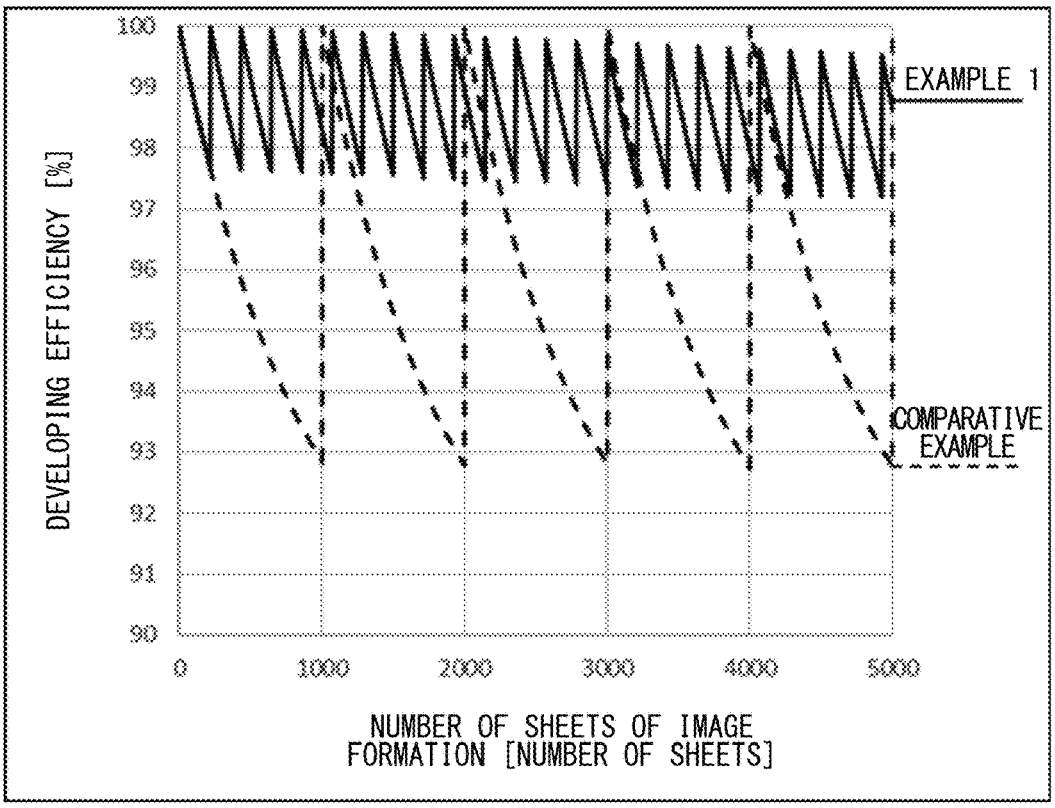
FIG. 12B is a diagram showing a change in the developing efficiency in example 1 of this disclosure.

FIG. 12A shows a graph which indicates how the concentrations of the charge control agent change in a case of the means of controlling the concentration of the charge control agent described above and in a case of a comparative example (control means of replenishing the charge control agent by detecting the concentration of the charge control agent every 1,000 sheets of the image formation). At this time, the peeling rate of the charge control agent, the image coverage in a normal printing mode, and the pre-use concentration of the charge control agent were respectively set at 70%, 10%, and 0.1 wt %, and the control of the concentration of the charge control agent based of the predicting means described above was performed in a case where the updated predicted value Y of the concentration of the charge control agent fell below the specified value Z of 0.08. Further, the level for the recovery judgement was set at the pre-use concentration of the charge control agent. As shown in FIG. 12A, while, in the comparative example (broken line), the concentration of the charge control agent is reduced by 62.0% at the maximum with respect to an initial concentration at a time of 5,000 sheets of the image formation, in a case where the means of controlling the concentration of the charge control agent described above is used (solid line), it is possible to suppress the reduction to 23.9% at the maximum with respect to the initial concentration at the time of 5,000 sheets of the image formation. Further, FIG. 12B shows changes in developing efficiency (movement rate of the toner at the developing nip portion). While, in the case of the comparative example (broken line), a decrease in the developing efficiency at the time of 5,000 sheets of the image formation is 7.2% at the maximum, in the case where the means of controlling the concentration of the charge control agent described above is used (solid line), the decrease in the developing efficiency at the time of 5,000 sheets of the image formation is 2.8% at the maximum. By this disclosure, it is possible to suppress the decrease in the developing efficiency, and, eventually, possible to suppress the decrease in the image density. To be noted, while the control of the concentration of the charge control agent has been described by taking the developing unit 50K as an example in the descriptions above, a similar control is performed in the developing units 50Y, 50M, and 50C.

By this disclosure, since an amount of the charge control agent that has been consumed is predicted from the image coverage of the output image, it is not necessary to newly form the toner image for the detection of the concentration of the charge control agent. Herewith, it is possible to easily perform the control of the concentration of the charge control agent at shorter intervals in comparison with a case forming the toner image for the detection, and possible to stabilize the image density in comparison with the comparative example.

Example 2

Next, a different example of this disclosure will be described. To be noted, since most of configurations and movements of an image forming apparatus of this example and example 1 are similar to each other, only differences from example 1 will be described.

Image Forming Apparatus

Since an image forming apparatus is identical to the image forming apparatus of example 1, descriptions will be omitted herein.

Developing Apparatus

Figure 4:
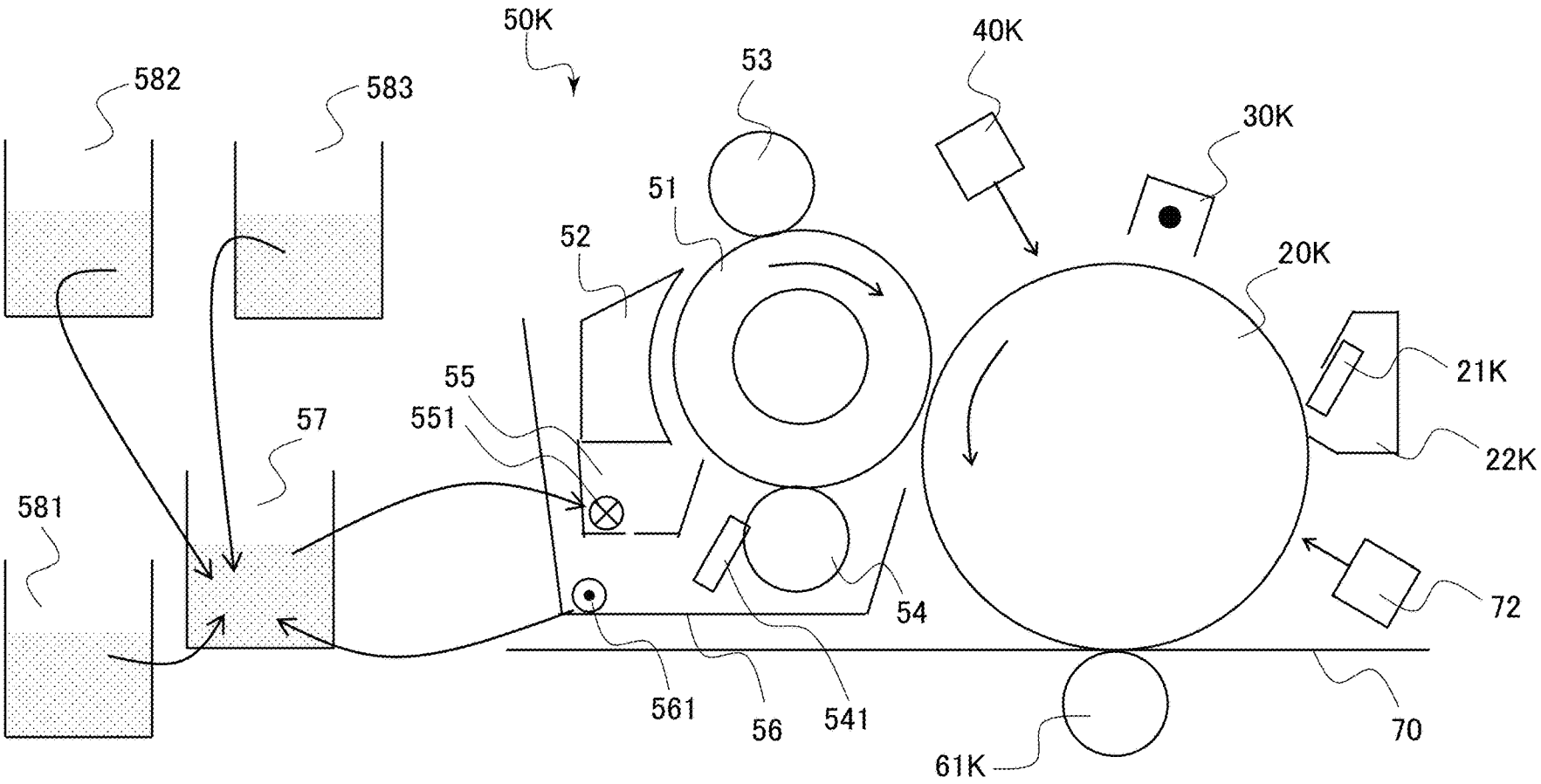
FIG. 4 is a configuration of a developing apparatus of an example 2 of this disclosure.

Regarding a configuration of a developing apparatus of this example, differences from example 1 will be described based on FIG. 4.

As described in example 1, the toner image is formed on the photosensitive drum 20K.

An optical reflection density measuring instrument 72 is disposed downstream of this photosensitive drum 20K. The optical reflection density measuring instrument 72 is capable of emitting light on the toner image, that has been formed, and detecting an optical reflection density of the developer from reflected light. Further, by referring to a correspondence table, which has been prepared by a measurement performed beforehand, of the optical reflection density and the concentration of the charge control agent, it is possible to detect the concentration of the charge control agent in the developer.

Means of Predicting Concentration of Charge Control Agent

Since a means of predicting the concentration of the charge control agent is identical to the means of predicting the concentration of the charge control agent of example 1, descriptions will be omitted herein.

Means of Controlling Concentration of Charge Control Agent

Next, a means of controlling the concentration of the charge control agent performed when the reduction in the concentration of the charge control agent has been predicted by the means of predicting the concentration of the charge control agent will be described in detail.

Figure 5:
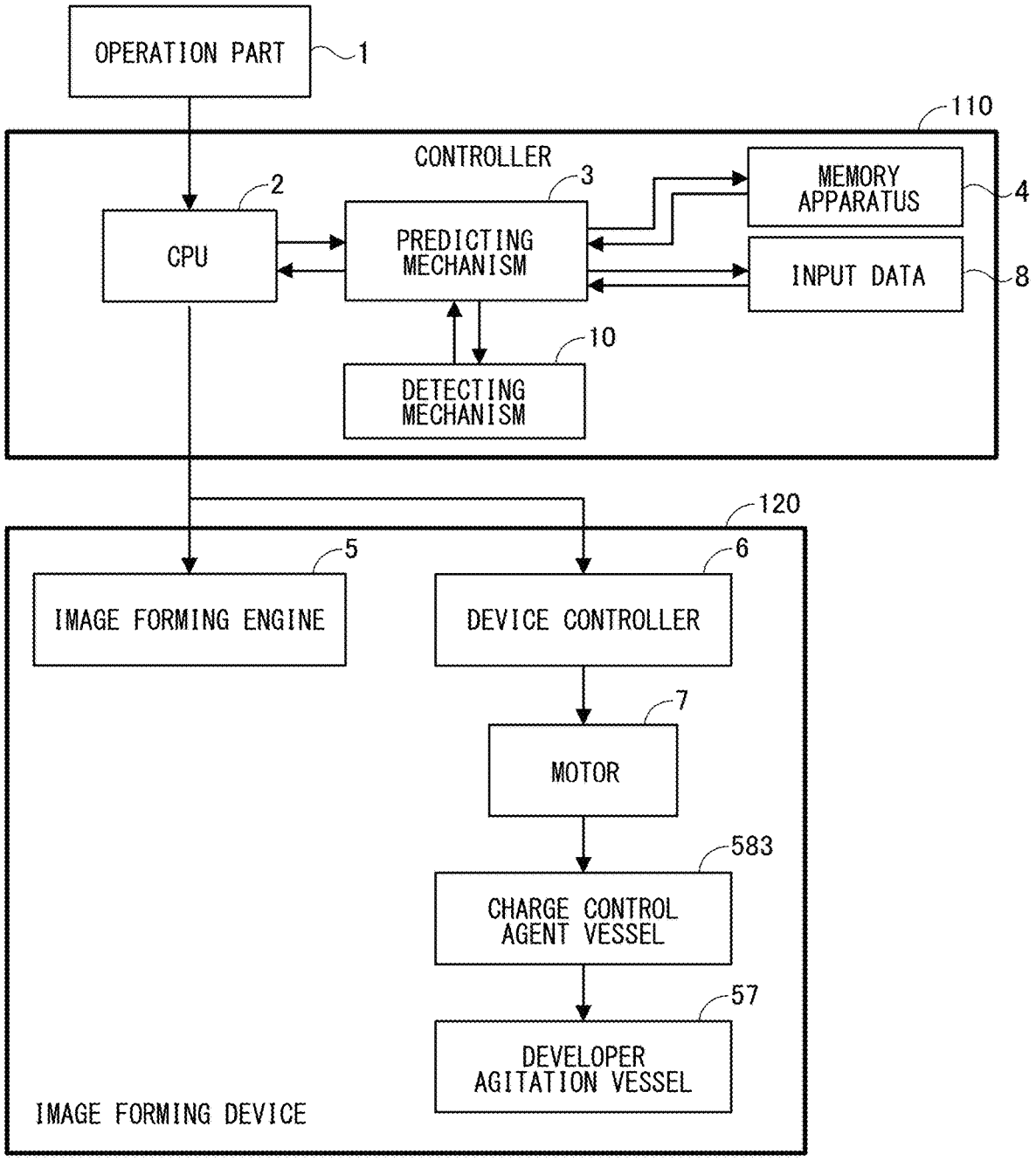
FIG. 5 is a block diagram showing a control system relating to example 2 of this disclosure.

FIG. 5 indicates extracted parts of the control system necessary for embodying a method of this disclosure in example 2. Differences from FIG. 3 of a block diagram of example 1 will be described based on FIG. 5. The predicting mechanism 3 executes a detecting mechanism 10 based on the cumulative total of sheets of the image formation transmitted from the CPU 2, and receives the data of the concentration of the charge control agent. The updated predicted value of the concentration of the charge control agent is changed corresponding to the data of the concentration of the charge control agent that has been received.

Figure 7:
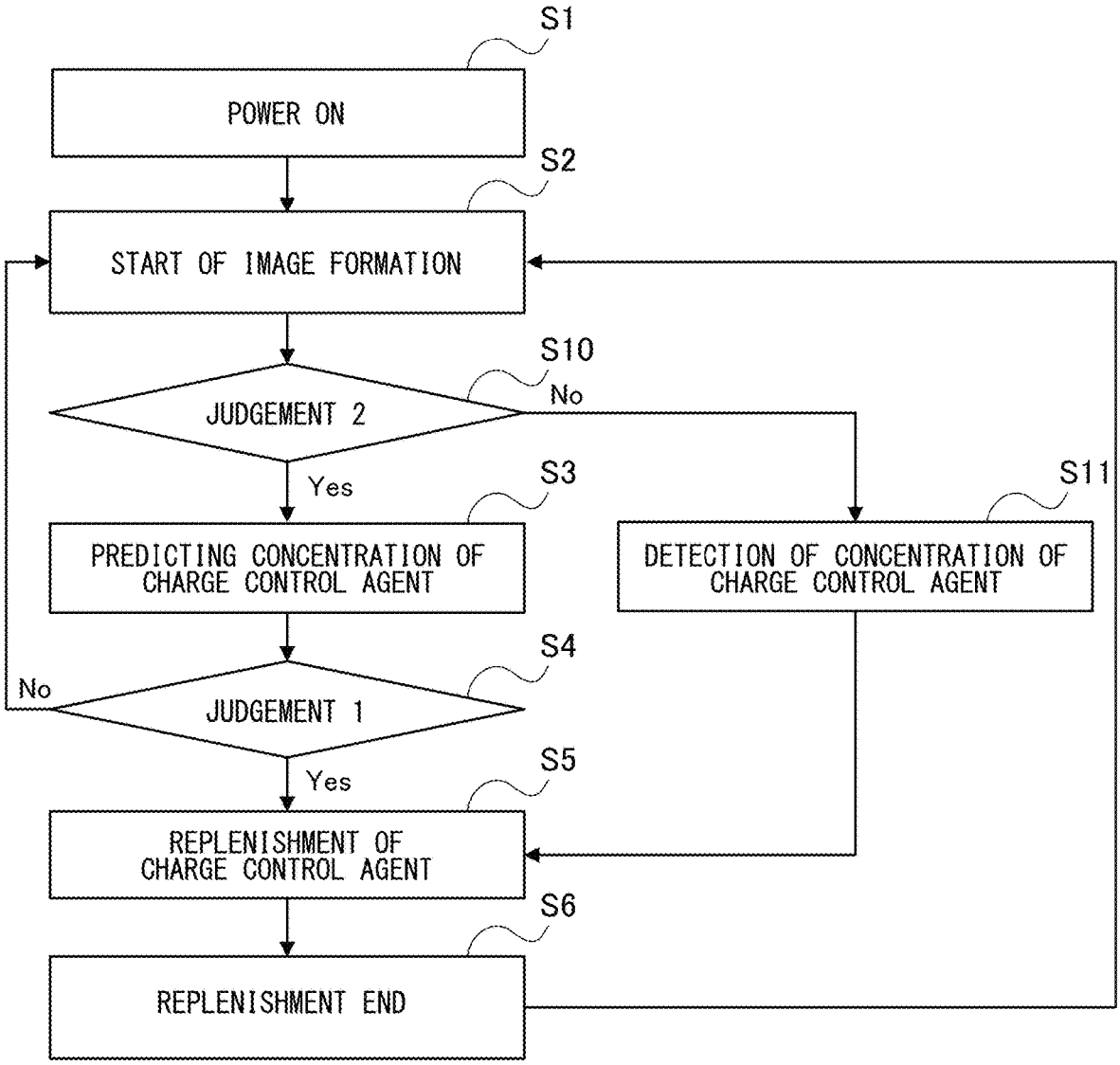
FIG. 7 is a diagram showing the control flowchart of the embodiments of this disclosure.

In a means of detecting the concentration of the charge control agent described above, the toner image for the detection is formed every time when a number of sheets of the image formation A has exceeded a specified number of sheets B (for example, 2,000 sheets which is twice larger than a number of sheets of the image formation by which the concentration of the charge control agent is detected in the comparative example), namely when A becomes equal to or larger than B (JUDGMENT 2, STEP S10 in FIG. 7: NO), and the updated predicted value Y of the concentration of the charge control agent is changed based on the optical reflection density detected by the optical reflection density measuring instrument 72 (STEP S11). Since the updated predicted value Y of the concentration of the charge control agent is changed corresponding to the concentration of the charge control agent obtained by the means of detecting the concentration of the charge control agent described above and the charge control agent is replenished from the charge control agent container 583, it is possible to increase the concentration of the charge control agent inside developer agitation container 57 more accurately, and recover the concentration of the charge control agent that has been decreased.

Figure 13A:
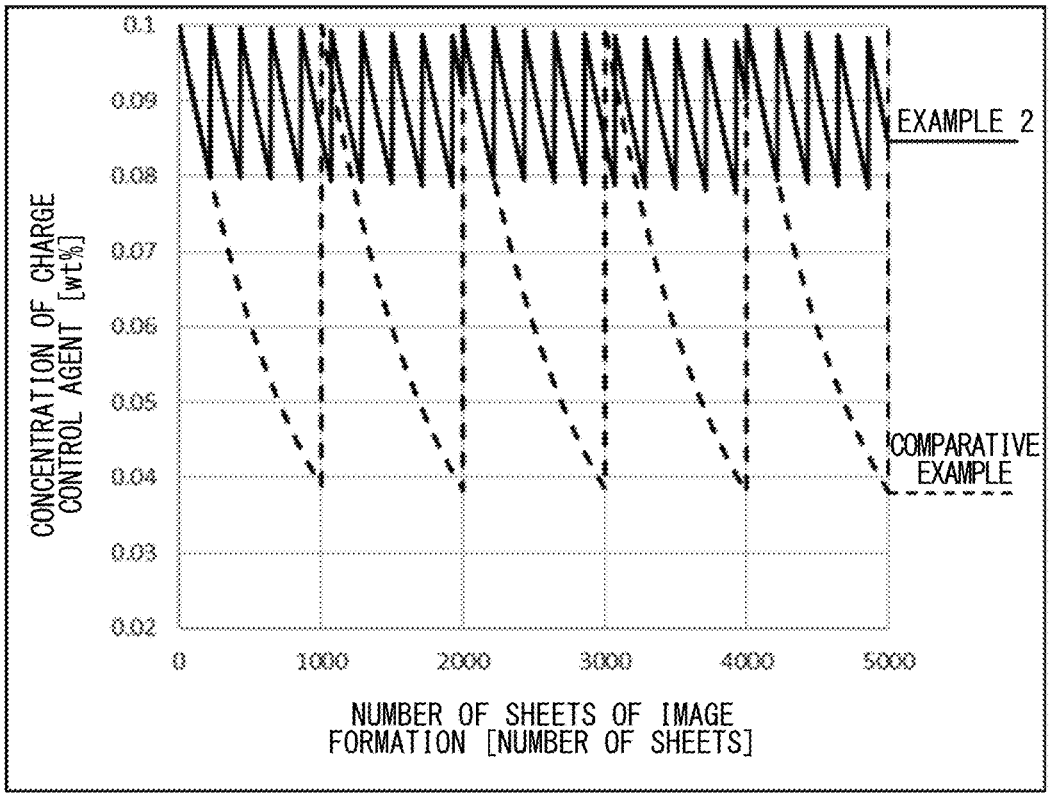
FIG. 13A is a diagram showing a change in the concentration of the charge control agent in example 2 of this disclosure.
Figure 13B:
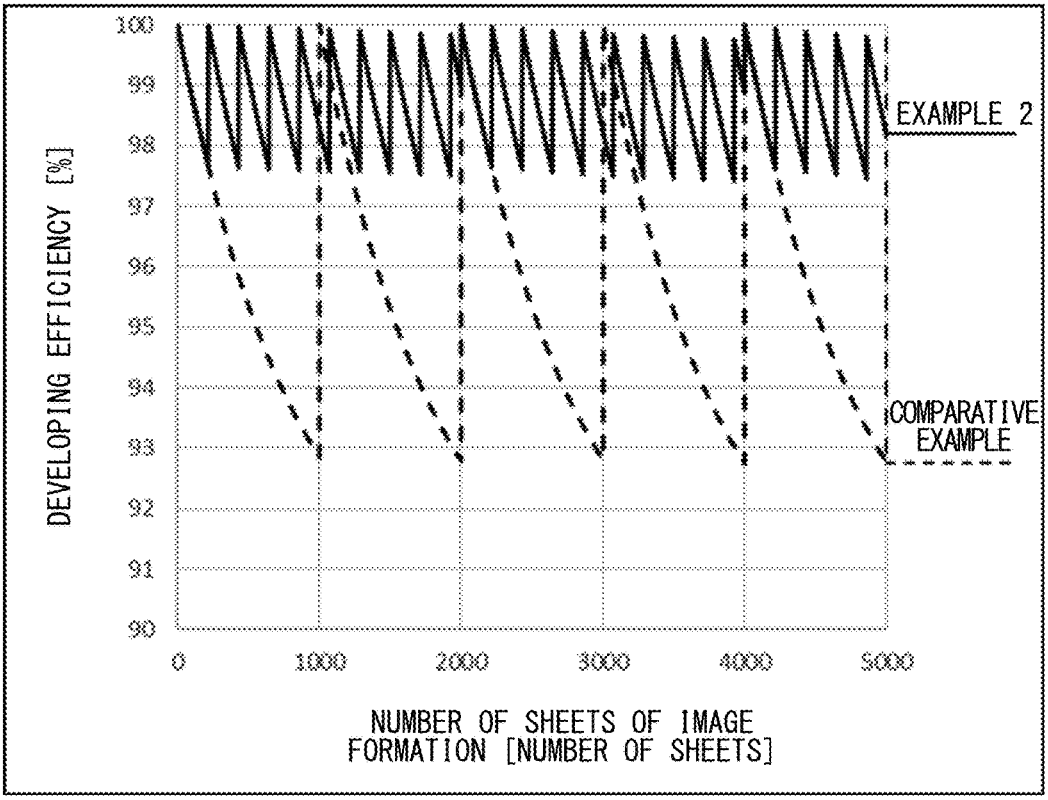
FIG. 13B is a diagram showing a change in the developing efficiency in example 2 of this disclosure.

FIG. 13A shows a graph indicating how the concentrations of the charge control agent change in the liquid developer inside the developer agitation container 57 in a case of the means of controlling the concentration of the charge control agent described above and in the case of the comparative example (control means of replenishing the charge control agent by detecting the concentration of the charge control agent every 1,000 sheets of the image formation). At this time, the peeling rate of the charge control agent, the image coverage in the normal printing mode, and the pre-use concentration of the charge control agent were respectively set at 70%, 10%, and 0.1 wt %. The control of the concentration of the charge control agent by the control means described above was performed in a case where the updated predicted value Y of the concentration of the charge control agent fell below the specified value Z of 0.08, and also the concentration of the charge control agent was detected every specified number of sheets B that was equal to 2,000 sheets. Further, the level for the recovery judgement was set at the pre-use concentration of the charge control agent. As shown in FIG. 13A, while, in the comparative example (broken line), the concentration of the charge control agent is reduced by 62.0% at the maximum with respect to the initial concentration at the time of 5,000 sheets of the image formation, in a case where the means of controlling the concentration of the charge control agent described above is used (solid line), it is possible to suppress the reduction to 21.6% at the maximum with respect to the initial concentration at the time of 5,000 sheets of the image formation. FIG. 13B shows changes in the developing efficiency. In the case where the means of controlling the concentration of the charge control agent described above is used (solid line), the decrease in the developing efficiency at the time of 5,000 sheets of the image formation is 2.5% at the maximum. By this disclosure, it is possible to further suppress the decrease in the developing efficiency in comparison with the example 1, and, eventually, possible to suppress the decrease in the image density.

While it is necessary to periodically form the toner image for the detection as hitherto, it is possible to extend the detection interval longer than the interval hitherto while maintaining the stability of the image density.

Figure 9:
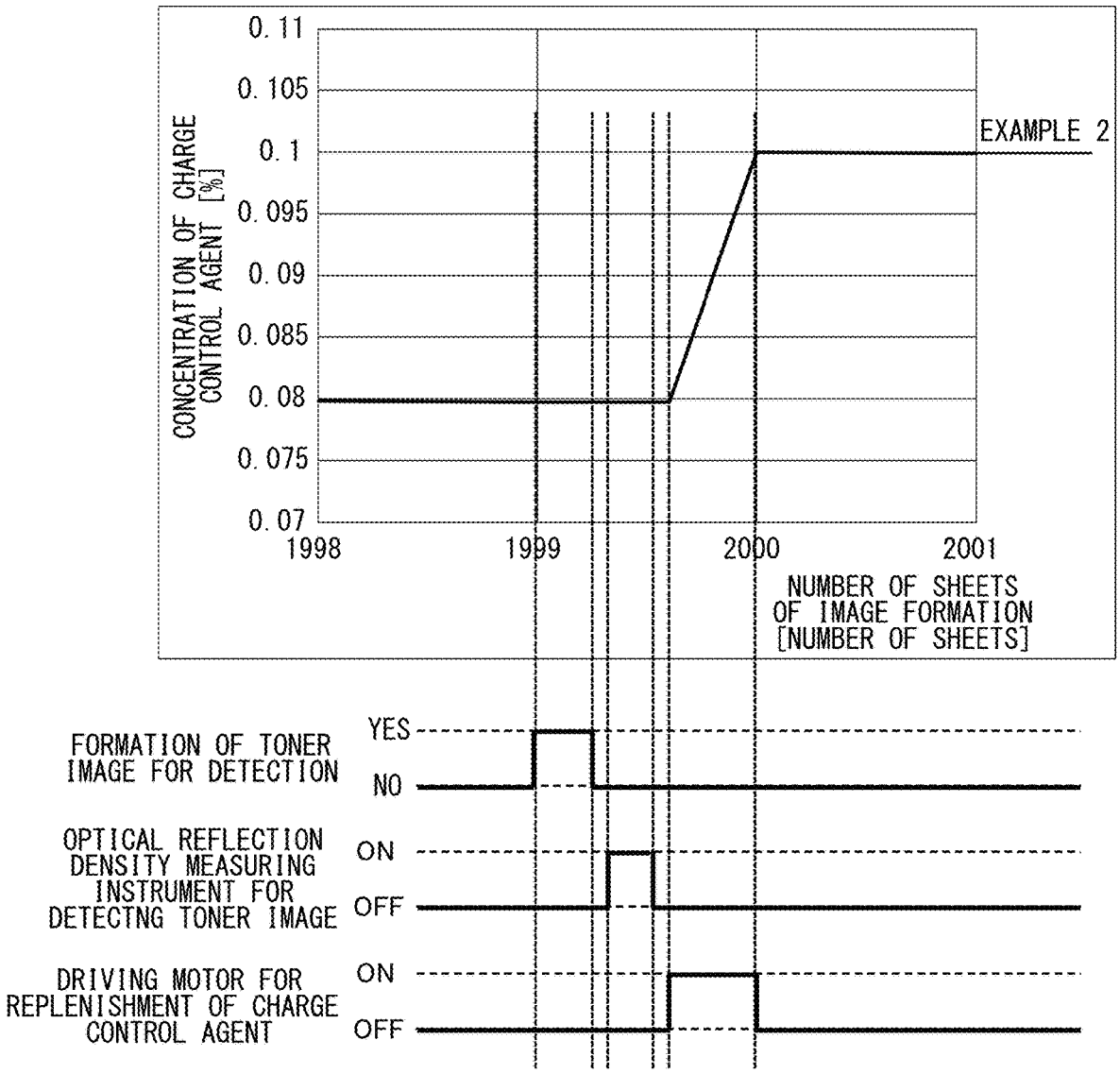
FIG. 9 is a schematic diagram showing the control time chart of the embodiments of this disclosure.

FIG. 7 shows a control flowchart of example 2, and FIG. 9 shows a schematic diagram of a time chart after JUDGEMENT 2.

Example 3

Image Forming Apparatus

Since an image forming apparatus is identical to the image forming apparatus of example 2, descriptions will be omitted herein.

Developing Apparatus

Since a configuration of a developing apparatus is identical to the configuration of the developing apparatus of example 2, descriptions will be omitted herein.

Means of Predicting Concentration of Charge Control Agent

Since a means of predicting the concentration of the charge control agent is identical to the means of predicting the concentration of the charge control agent of example 2, descriptions will be omitted herein.

Means of Controlling Concentration of Charge Control Agent

Next, regarding a means of controlling the concentration of the charge control agent performed when the reduction in the concentration of the charge control agent has been predicted by the means of predicting the concentration of the charge control agent, differences from example 2 will be described in detail.

Figure 14:
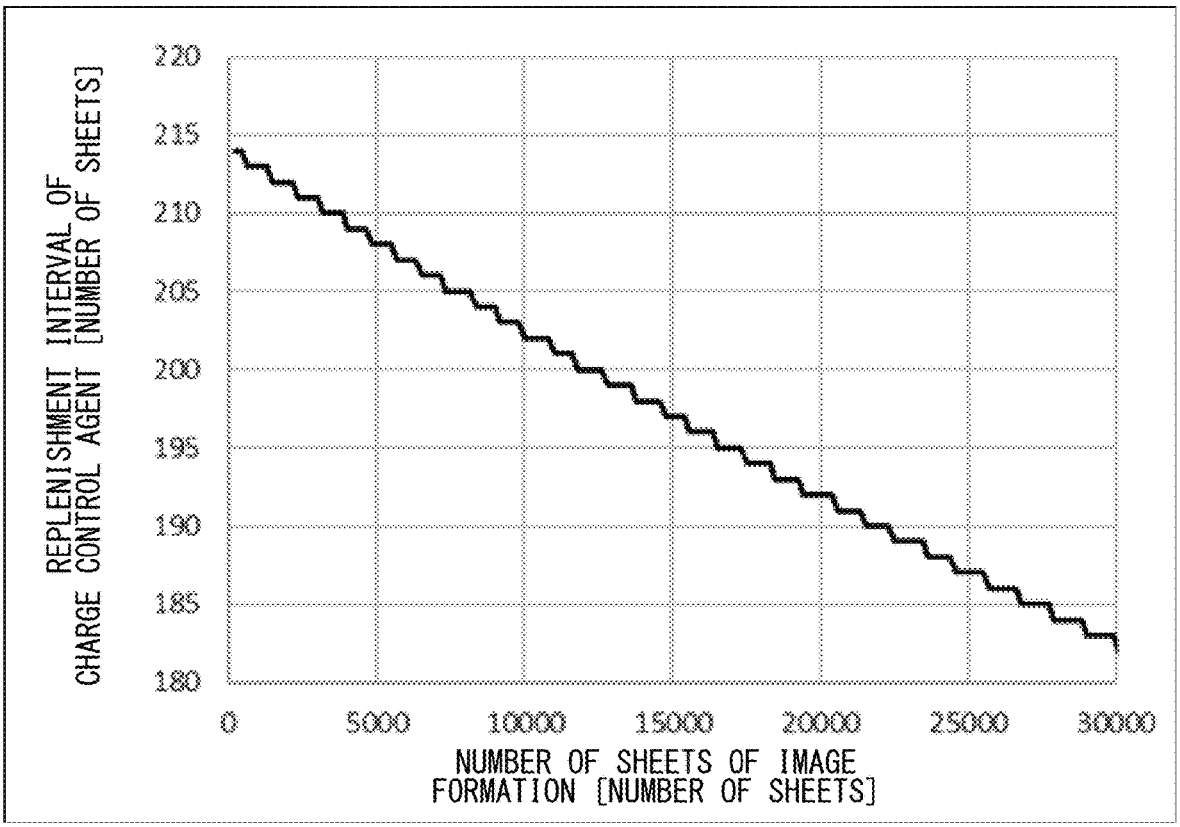
FIG. 14 is a diagram showing a change of a replenishment interval of the charge control agent with respect to the endurance status of a liquid developer.

The liquid developer degrades depending on endurance status, and the peeling rate of the charge control agent also changes. Therefore, in an example 3, the predicting mechanism 3 in FIG. 5 changes the updated predicted value Y of the concentration of the charge control agent corresponding to the endurance status of the liquid developer, and a replenishment interval of the charge control agent is changed accordingly. FIG. 14 shows changes in the replenishment interval of the charge control agent with respect to the endurance status of the liquid developer. FIG. 14 shows the changes in the replenishment interval of the charge control agent up to 30,000 sheets of the image formation in a case where an initial peeling rate of the charge control agent, the image coverage in the normal printing mode, the pre-use concentration of the charge control agent are respectively 70%, 10%, and 0.1 wt % and the charge control agent is replenished when the predicted value Y of the concentration of the charge control agent falls below the specified value Z of 0.08 (a change of a replenishment amount by the means of detecting the concentration of the charge control agent described above is not performed). Since the peeling rate of the charge control agent increases depending on the endurance status, it is necessary to control the replenishment amount of the charge control agent by shortening the replenishment interval of the charge control agent.

Figure 15:
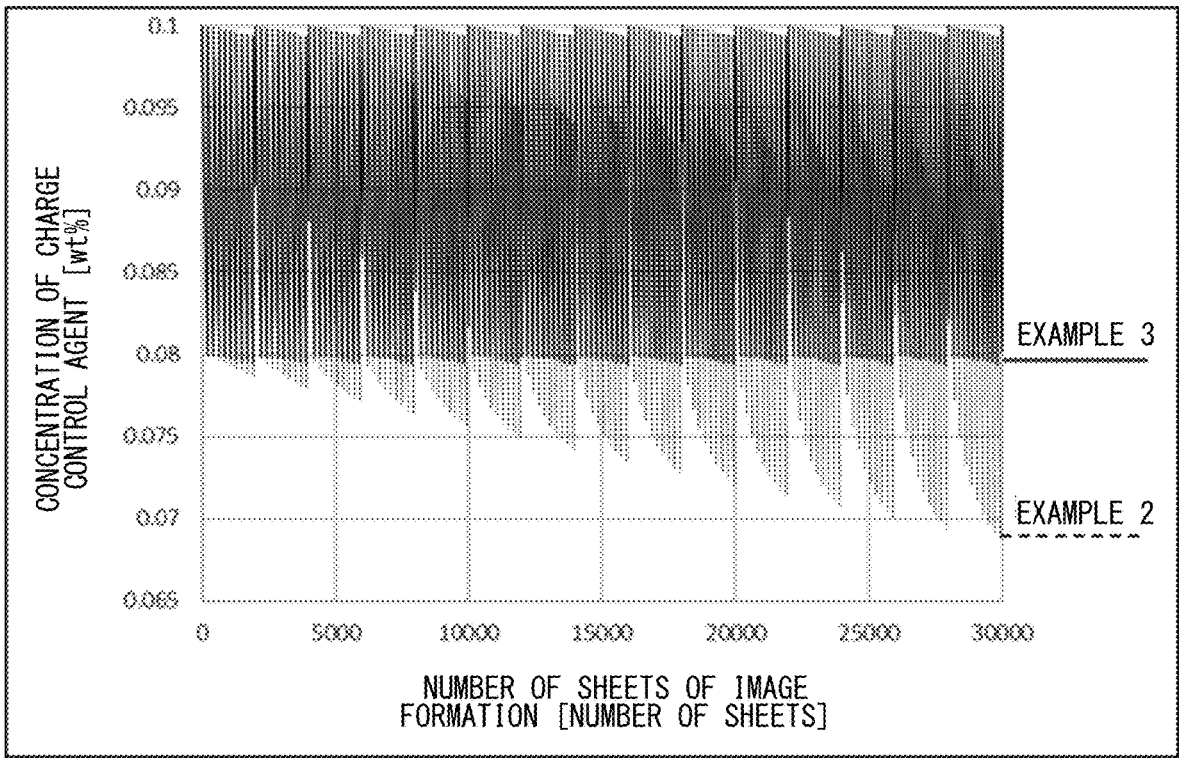
FIG. 15 is a diagram showing a change in the concentration of the charge control agent in an example 3 of this disclosure.

A graph of FIG. 15 shows how the concentrations of the charge control agent change in the liquid developer inside the developer agitation container 57 change in a case of the means of controlling the concentration of the charge control agent described above and in the case of the means of controlling the concentration of the charge control agent of example 2. At this time, the peeling rate of the charge control agent, the image coverage in the normal printing mode, and the pre-use concentration of the charge control agent were respectively set at 70%, 10%, and 0.1 wt %, and the control of the concentration of the charge control agent by the control means described above was performed in a case where the updated predicted value Y of the concentration of the charge control agent fell below the specified value Z of 0.08, and also the concentration of the charge control agent was detected every specified number of sheets B that was equal to 2,000 sheets. As shown in FIG. 15, while, in a case where the means of controlling the concentration of the charge control agent of the example 2 (broken line) is used, the concentration of the charge control agent is reduced by 31.2% at the maximum with respect to the initial concentration at a time of 30,000 sheets of the image formation, in a case where the means of controlling the concentration of the charge control agent described above is used (solid line), it is possible to suppress the reduction to 20.9% at the maximum with respect to the initial concentration at the time of 30,000 sheets of the image formation. That is, in comparison with example 2, it is possible to suppress the decrease in the concentration of the charge control agent, and stabilize the image density.

Example 4

Image Forming Apparatus

Since an image forming apparatus is identical to the image forming apparatus of example 1, descriptions will be omitted herein.

Developing Apparatus

Since a configuration of a developing apparatus is identical to the configuration of the developing apparatus of example 1, descriptions will be omitted herein.

Means of Predicting Concentration of Charge Control Agent

Since a means of predicting the concentration of the charge control agent in the liquid developer is identical to the means of predicting the concentration of the charge control agent in the liquid developer of example 1, descriptions will be omitted herein.

Means of Controlling Concentration of Charge Control Agent

Figure 16:
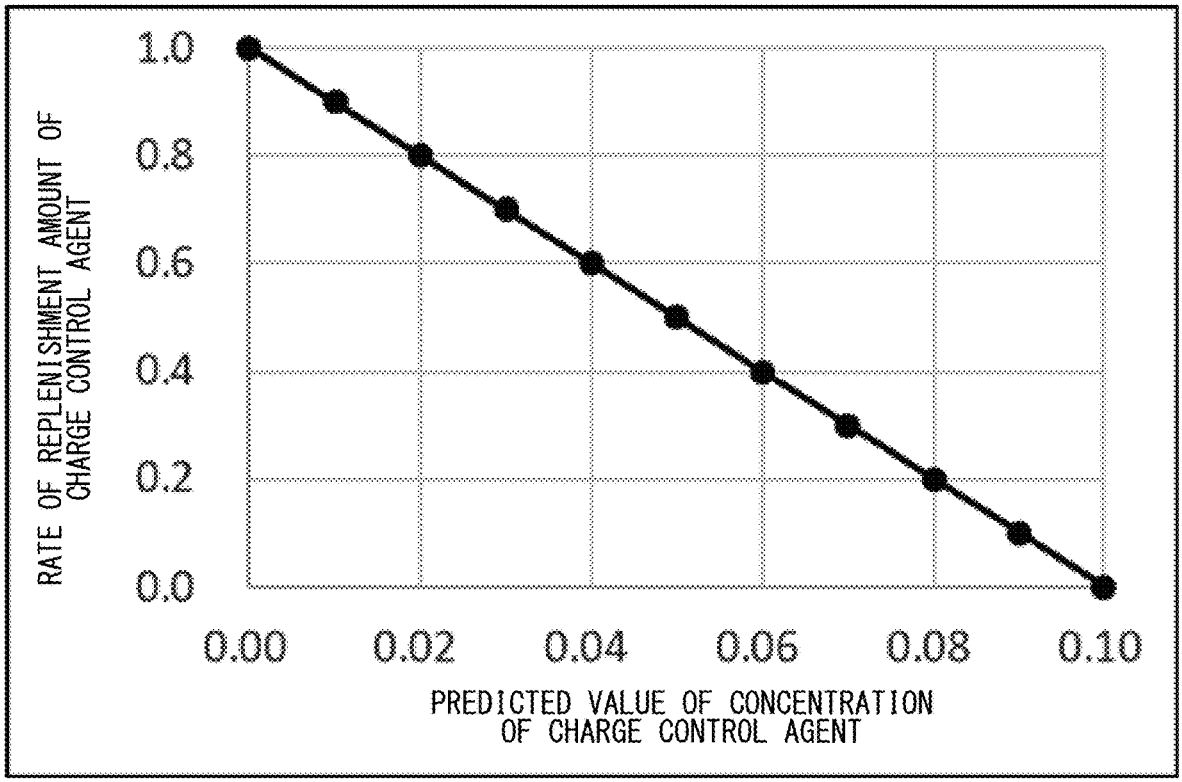
FIG. 16 is a diagram showing a relationship between a predicted value of the concentration of the charge control agent and a rate of a replenishment amount of the charge control agent in an example 4 of this disclosure.

Next, regarding a means of controlling the concentration of the charge control agent performed when the decrease in the concentration of the charge control agent has been predicted by the means of predicting the concentration of the charge control agent, differences from the example 1 will be described in detail. While, in example 1, in the case where the updated predicted value Y of the concentration of the charge control agent falls below a certain specified value Z, the charge control agent is replenished to the predetermined level of the recovery judgement of the concentration of the charge control agent in the liquid developer (for example, the pre-use concentration of the charge control agent), it is acceptable to maintain the concentration of the charge control agent by changing a replenishment amount at a time corresponding to the image coverage. Accordingly, in an example 4, the replenishment amount of the charge control agent is changed corresponding to the updated predicted value Y of the concentration of the charge control agent calculated from the data of the image coverage every specified replenishment interval γ (for example, every 200 sheets). FIG. 16 shows a relative rate of the replenishment amount of the charge control agent with respect to the updated predicted value of the concentration of the charge control agent in which the relative rate of the replenishment amount of the charge control agent is one in a case where the peeling rate of the charge control agent, the pre-use concentration of the charge control agent, and the predicted value of the concentration of the charge control agent are respectively 70%, 0.1 wt %, and zero. That is, the means of controlling the concentration of the charge control agent changes the replenishment amount of the charge control agent by controlling the motor 7 so that the replenishment amount of the charge control agent from the charge control agent container 583 in a case where the image coverage of the output image is a second ratio becomes more than the replenishment amount of the charge control agent from the charge control agent container 583 in a case where the image coverage of the output image is a first ratio that is larger than the second ratio.

Figure 17:
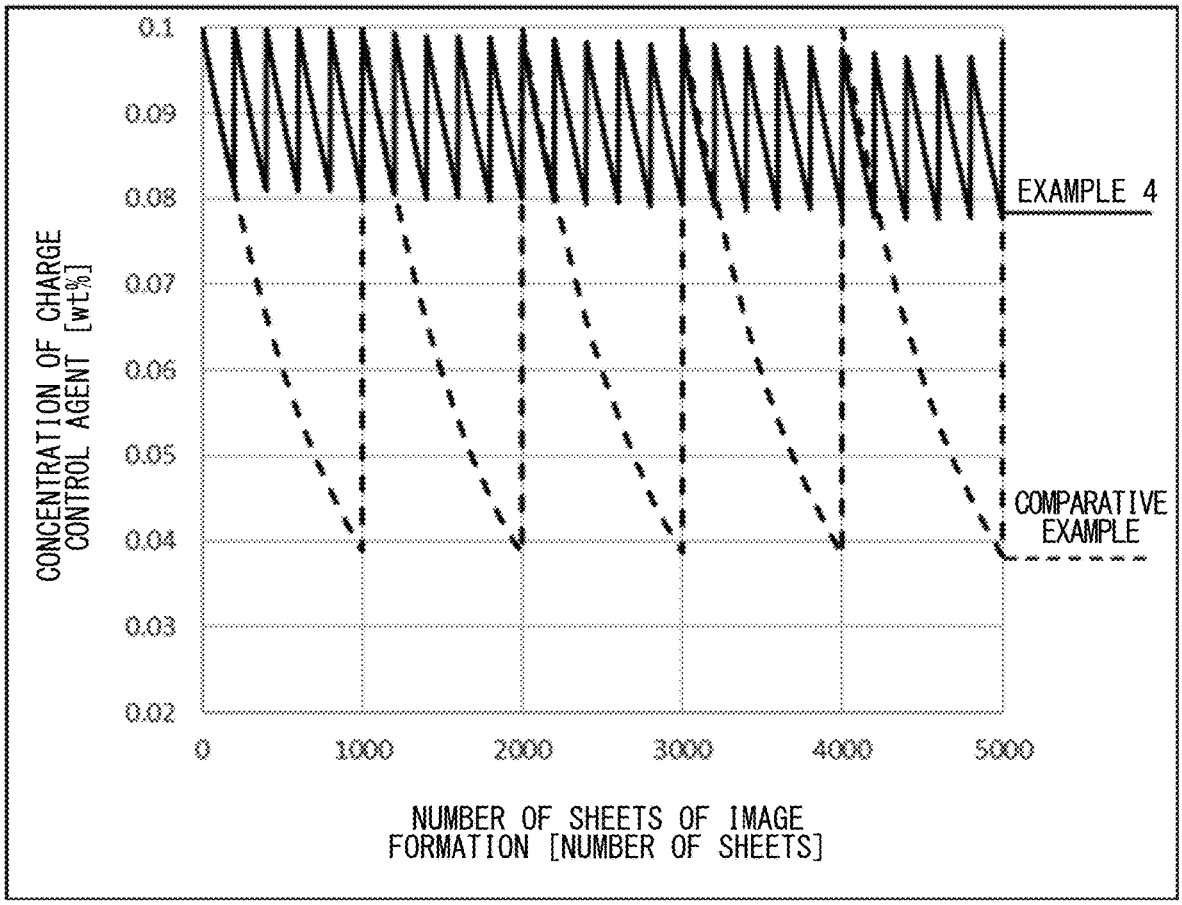
FIG. 17 is a diagram showing a change in the concentration of the charge control agent in example 4 of this disclosure.

FIG. 17 shows how the concentrations of the charge control agent in the liquid developer inside the developer agitation container 57 change in a case of the means of controlling the concentration of the charge control agent described above and in the case of the comparative example (control means of replenishing the charge control agent by detecting the concentration of the charge control agent every 1,000 sheets of the image formation). At this time, the peeling rate of the charge control agent was 70%, the image coverage was changed randomly between 0 and 20% for each sheet, and the pre-use concentration of the charge control agent was set at 0.1 wt %. While, in the comparative example (broken line), the concentration of the charge control agent is reduced by 62.0% at the maximum with respect to the initial concentration at the time of 5,000 sheets of the image formation, in a case where the means of controlling the concentration of the charge control agent described above is used (solid line), it is possible to suppress the reduction to 23.0% at the maximum with respect to the initial concentration at the time of 5,000 sheets of the image formation. That is, by this disclosure, it is possible to stabilize the image density in comparison with the comparative example.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-172010, filed on Oct. 12, 2020 and Japanese Patent Application No. 2021-143046, filed on Sep. 2, 2021, which are hereby incorporated by reference herein in their entirety.

What is claimed is:

1. An image forming apparatus comprising:

an image bearing member on which an electrostatic image is formed;

an exposing unit configured to expose the image bearing member so as to form the electrostatic image on the image bearing member;

a developing apparatus comprising a developing container and a developer bearing member, the developing container being configured to accommodate a liquid developer containing a toner and a carrier fluid, the developer bearing member being configured to bear and convey the liquid developer so as to develop the electrostatic image formed on the image bearing member;

a first container configured to accommodate the liquid developer for replenishment to the developing container;

a second container configured to accommodate the carrier fluid containing a charge control agent for replenishment to the first container, the concentration of the charge control agent in the carrier fluid accommodated in the second container being between equal to or more than 10 wt % and equal to or less than 20 wt %;

a driving unit configured to be driven so as to replenish the charge control agent accommodated in the second container to the first container; and a control unit configured to control the driving unit based on image coverage of an output image so that a concentration of the charge control agent in the liquid developer accommodated in the first container becomes a predetermined value.

2. The image forming apparatus according to claim 1, further comprising a third container configured to accommodate the carrier fluid for replenishment to the first container, the concentration of the charge control agent in the carrier fluid accommodated in the third container being 0 wt %;

a fourth container configured to accommodate the toner for replenishment to the first container, the concentration of the charge control agent in the toner accommodated in the fourth container being 0 wt %; and an agitation member disposed in the first container, and configured to agitate the carrier fluid containing the charge control agent replenished from the second container, the carrier fluid replenished from the third container, and the toner replenished from the fourth container.

3. An image forming apparatus comprising:

an image bearing member on which an electrostatic image is formed;

an exposing unit configured to expose the image bearing member so as to form the electrostatic image on the image bearing member;

a developing apparatus comprising a developing container and a developer bearing member, the developing container being configured to accommodate a liquid developer containing a toner and a carrier fluid, the developer bearing member being configured to bear and convey the liquid developer so as to develop the electrostatic image formed on the image bearing member;

a first container configured to accommodate the liquid developer for replenishment to the developing container;

a second container configured to accommodate the carrier fluid containing a charge control agent for replenishment to the first container, the concentration of the charge control agent in the carrier fluid accommodated in the second container being between equal to or more than 10 wt % and equal to or less than 20 wt %;

a driving unit configured to be driven so as to replenish the charge control agent accommodated in the second container to the first container; and a control unit configured to control the driving unit so that a replenishment amount of the charge control agent replenished from the second container to the first container in a case where image coverage of an output image is a second ratio is more than the replenishment amount in a case where the image coverage of the output image is a first ratio that is larger than the second ratio.

4. The image forming apparatus according to claim 3, further comprising a third container configured to accommodate the carrier fluid for replenishment to the first container, the concentration of the charge control agent in the carrier fluid accommodated in the third container being 0 wt %;

a fourth container configured to accommodate the toner for replenishment to the first container, the concentration of the charge control agent in the toner accommodated in the fourth container being 0 wt %; and an agitation member disposed in the first container, and configured to agitate the carrier fluid containing the charge control agent replenished from the second container, the carrier fluid replenished from the third container, and the toner replenished from the fourth container.

5. An image forming apparatus comprising:

an image bearing member on which an electrostatic image is formed;

an exposing unit configured to expose the image bearing member so as to form the electrostatic image on the image bearing member;

a developing apparatus comprising a developing container and a developer bearing member, the developing container being configured to accommodate a liquid developer containing a toner and a carrier fluid, the developer bearing member being configured to bear and convey the liquid developer so as to develop the electrostatic image formed on the image bearing member;

a first container configured to accommodate the liquid developer for replenishment to the developing container;

a second container configured to accommodate a charge control agent for replenishment to the first container;

a third container configured to accommodate the carrier fluid for replenishment to the first container;

a fourth container configured to accommodate the toner for replenishment to the first container;

an agitation member disposed in the first container, and configured to agitate the charge control agent replenished from the second container, the carrier fluid replenished from the third container, and the toner replenished from the fourth container;

a driving unit configured to be driven so as to replenish the charge control agent accommodated in the second container to the first container; and a control unit configured to control the driving unit based on image coverage of an output image so that a concentration of the charge control agent in the liquid developer accommodated in the first container becomes a predetermined value.

6. An image forming apparatus comprising:

an image bearing member on which an electrostatic image is formed;

an exposing unit configured to expose the image bearing member so as to form the electrostatic image on the image bearing member;

a developing apparatus comprising a developing container and a developer bearing member, the developing container being configured to accommodate a liquid developer containing a toner and a carrier fluid, the developer bearing member being configured to bear and convey the liquid developer so as to develop the electrostatic image formed on the image bearing member;

a first container configured to accommodate the liquid developer for replenishment to the developing container;

a second container configured to accommodate a charge control agent for replenishment to the first container;

a third container configured to accommodate the carrier fluid for replenishment to the first container;

a fourth container configured to accommodate the toner for replenishment to the first container;

an agitation member disposed in the first container, and configured to agitate the charge control agent replenished from the second container, the carrier fluid replenished from the third container, and the toner replenished from the fourth container;

a driving unit configured to be driven so as to replenish the charge control agent accommodated in the second container to the first container; and a control unit configured to control the driving unit so that a replenishment amount of the charge control agent replenished from the second container to the first container in a case where image coverage of an output image is a second ratio is more than the replenishment amount in a case where the image coverage of the output image is a first ratio that is larger than the second ratio.

* * * * *